United States Patent [19]

Fuller et al.

[11] Patent Number: 5,004,664

[45] Date of Patent: Apr. 2, 1991

[54] TONER AND DEVELOPER COMPOSITIONS CONTAINING BIODEGRADABLE SEMICRYSTALLINE POLYESTERS

[75] Inventors: Timothy J. Fuller, West Henrietta, N.Y.; Robert H. Marchessault, Montreal; Terry L. Bluhm, Oakville, both of Canada

[73] Assignee: Xerox Corporation, Stamford, Conn.

[21] Appl. No.: 316,070

[22] Filed: Feb. 27, 1989

[51] Int. Cl.[5] ..... G03G 9/087; G03G 9/083

[52] U.S. Cl. ..... 430/106.6; 430/109; 430/110; 430/111; 528/354; 524/431; 524/599

[58] Field of Search ..... 430/109, 110, 111, 106.6; 528/354

[56] References Cited

U.S. PATENT DOCUMENTS

| | | | |
|---|---|---|---|
| 3,542,822 | 11/1970 | Starks . | |
| 3,590,000 | 6/1971 | Palermiti et al. . | |
| 3,654,865 | 4/1972 | Tamai | 101/463 |
| 3,655,374 | 4/1972 | Palermiti et al. . | |
| 4,013,572 | 3/1977 | Marsh et al. . | |
| 4,049,447 | 9/1977 | Azar et al. . | |
| 4,104,066 | 8/1978 | Williams . | |
| 4,105,572 | 8/1978 | Gorondy . | |
| 4,186,003 | 1/1980 | Marsh et al. | 430/97 |
| 4,298,672 | 11/1981 | Lu | 430/108 |
| 4,952,477 | 8/1990 | Fuller et al. | 430/109 |

FOREIGN PATENT DOCUMENTS

| | | |
|---|---|---|
| 0069497 | 3/1982 | European Pat. Off. . |
| 0052459 | 5/1982 | European Pat. Off. . |

OTHER PUBLICATIONS

Macromolecules (1987), 20, 3086, "Synthesis of Crystalline Beta-Hydroxybutyrate/Beta-Hydroxyvalerate Copolyesters by Coordination Polymerization of Beta--Lactones", S. Bloembergen et al.

Biomaterials, 8, 289 to 295 (1987), "Polymers for Biodegradable Medical Devices", S. J. Holland et al.

*Primary Examiner*—Roland Martin

*Attorney, Agent, or Firm*—E. O. Palazzo

[57] ABSTRACT

A toner composition comprised of semicrystalline polyester resin particles, especially polyhydroxyalkanoates, copolymers thereof, or blends, and pigment particles. Processes for the preparation of the semicrystalline polyester resins by ring opening polymerization of a monomer in the presence of a catalyst is also illustrated.

23 Claims, No Drawings

TONER AND DEVELOPER COMPOSITIONS CONTAINING BIODEGRADABLE SEMICRYSTALLINE POLYESTERS

BACKGROUND OF THE INVENTION

This invention is generally directed to toner and developer compositions, and more specifically the present invention is directed to toner compositions, including magnetic, single component, two component, and colored toner compositions comprised of polyesters. In one embodiment of the present invention, the toner compositions are comprised of biodegradable semicrystalline polyesters, including specifically, for example, polyhydroxyalkanoates, copolymers thereof, or blends, that is, a uniform mixture whose component parts are substantially indistinquishable thereof, and pigment particles. There is also provided in accordance with the present invention positively charged toner compositions comprised of biodegradable, that is particles that degrade, for example, under environmental conditions present in streams, landfill sites, and the like, semicrystalline polyester resin particles, pigment particles, and charge enhancing additives. Furthermore, there is provided in accordance with the present invention toner compositions comprised of biodegradable semicrystalline polyester resin particles, and optional additives, especially surface additives such as metal salts of fatty acids including zinc stearate, and colloidal silica particles such as the Aerosils. In addition, the present invention is directed to developer compositions comprised of the aforementioned toners, and carrier particles. Furthermore, in another embodiment of the present invention there are provided single component toner compositions comprised of biodegradable semicrystalline polyester resin particles, magnetic components such as magnetites, optional charge enhancing additives, and optional surface additives. The toner and developer compositions of the present invention are useful in electrostatographic imaging and printing systems, including the Xerox Corporation 1075 TM, 1065 TM, 9700 TM, and the like. The polyester toner resin compositions of the present invention are biodegradable, therefore there is enabled the facile and efficient deinking thereof, for example, from papers with developed images containing the aforementioned toners. It is believed that the semicrystalline polyester resin particles are degraded by, for example, enzymatic attack thereof by, for example, enzymes present in ground soil, and by aqueous hydrolysis. Specific semicrystalline polyesters that may be selected for the toners of the present invention, and processes for the preparation thereof are disclosed, for example, in *Macromolecules* (1987), 20, 3086, entitled "Synthesis of Crystalline Beta-Hydroxybutyrate/Beta-h,Hydroxyvalerate Copolyesters by Coordination Polymerization Of Beta-Lactones", and *Biomaterials*, 8, 289 to 295, (1987) "Polymers For Biodegradable Medical Devices", the disclosures of which are totally incorporated herein by reference. These processes, which generate synthetic products, are substantially different than the biological processes described in ICI European Patent Publication Nos. 0,052,459 and 0,069,497, the disclosures of which are totally incorporated herein by reference.

There is also provided in accordance with the present invention processes for the preparation of biodegradable semicrystalline polyesters, and processes for the preparation of toner compositions comprised of the aforementioned polyesters.

Toner compositions comprised of resin particles including styrene acrylates, styrene methacrylates, styrene butadienes, and polyesters, such as those illustrated in U.S. Pat. No. 3,590,000, are known. Also, toner compositions containing metal salts of fatty acids are disclosed in U.S. Pat. No. 3,655,374, the disclosure of which is totally incorporated herein by reference. Also, it is known that the aforementioned toner compositions with metal salts of fatty acids can be selected for electrostatic imaging methods wherein blade cleaning of the photoreceptor is accomplished, reference U.S. Pat. No. 3,635,704, the disclosure of which is totally incorporated herein by reference. Additionally, there are illustrated in U.S. Pat. No. 3,983,045, the disclosure of which is totally incorporated herein by reference, three component developer compositions comprising toner particles, a friction reducing material, and a finely divided nonsmearable abrasive material, reference column 4, beginning at line 31. Examples of friction reducing materials include saturated or unsaturated, substituted or unsubstituted, fatty acids preferably of from 8 to 35 carbon atoms, or metal salts of such fatty acids; fatty alcohols corresponding to said acids; mono and polyhydric alcohol esters of said acids and corresponding amides; polyethylene glycols and methoxypolyethylene glycols; terephthalic acids; and the like, reference column 7, lines 13 to 43.

Other references of interest which disclose toner compositions with various resins, such as amides and the like, include U.S. Pat. Nos. 4,072,521; 4,073,649 and 4,076,641. Furthermore, references of background interest are U.S. Pat. Nos. 3,165,420; 3,236,776; 4,145,300; 4,271,249; 4,556,624; 4,557,991 and 4,604,338.

Moreover, toner and developer compositions containing charge enhancing additives, especially additives which impart a positive charge to the toner resin, are well known. Thus, for example, there is described in U.S. Pat. No. 3,893,935 the use of certain quaternary ammonium salts as charge control agents for electrostatic toner compositions. There is also described in U.S. Pat. No. 2,986,521 reversal developer compositions comprised of toner resin particles coated with finely divided colloidal silica. According to the disclosure of this patent, the development of images on negatively charged surfaces is accomplished by applying a developer composition having a positively charged triboelectric relationship with respect to the colloidal silica. Further, there is illustrated in U.S. Pat. No. 4,338,390, the disclosure of which is totally incorporated herein by reference, developer and toner compositions having incorporated therein as charge enhancing additives organic sulfate and sulfonate compositions; and in U.S. Pat. No. 4,298,672, the disclosure of which is totally incorporated herein by reference, positively charged toner compositions containing resin particles and pigment particles, and as a charge enhancing additive alkyl pyridinium compounds, inclusive of cetyl pyridinium chloride. Other prior art disclosing positively charged toner compositions with charge enhancing additives include U.S. Pat. Nos. 3,944,493; 4,007,293; 4,079,014 and 4,394,430. Many of the aforementioned charge additives can be selected as an optional component for the toner compositions of the present invention as indicated herein.

As a result of a patentability search there were located U.S. Pat. Nos. (1) 3,654,865 which discloses gelatin toners; (2) 4,013,572 and 4,186,003 wherein photogradable toners are described; and (3) 4,105,572 which illustrates water soluble or solubilizable toner resins.

Although the above described toner and developer compositions are useful for their intended purposes, there is a need for improved compositions. More specifically, there is a need for biodegradable toner resin compositions, including single component, and colored toner compositions. There is also a need for biodegradable toner resin compositions comprised of semicrystalline bacterial polyesters, and semicrystalline polyesters obtained with the process of the present invention illustrated herein. In addition, there is a need for toner and developer compositions with semicrystalline polyesters that can be selected for electrophotographic imaging and printing processes. There is also a need for biodegradable toner compositions comprised of biodegradable semicrystalline polyesters that possess many other advantages including a blocking temperature of from about 80° to 180° C., and a minimum fix temperature of from about 200° to about 400° F., and preferably from about 300° to about 350° F. (fuser set temperature). Moreover there is a need for toner polymer resins with superior miscibility with pigments, such as carbon black, acceptable melt rheology characteristics, and which polymers can be readily extrudable. Additionally, there is a need for polymer toner resins that are biodegradable, chemically and/or biologically, thereby enabling deinking thereof. There is also a need for toners with semicrystalline polyesters, which toners provide excellent image quality with low background deposits are of superior fix and permanence. There is also a need for toners with lower fuser energy requirements as compared to, for example, several presently known toner compositions. Moreover, there is a need for an efficient economical synthetic process for the preparation of semicrystalline polyesters. Furthermore, there is a need for encapsulated toners comprised of the cores of biodegradable polyesters illustrated herein.

SUMMARY OF THE INVENTION

It is an object of the present invention to provide toner and developer compositions which possess many of the advantages illustrated herein.

Another object of the present invention resides in the provision of toner and developer compositions with stable triboelectrical characteristics for extended time periods.

In another object of the present invention there are provided toner and developer compositions that enable excellent image quality.

Moreover, another object of the present invention relates to the provision of toner resin compositions that are biodegradable.

In another object of the present invention there are provided toner and developer compositions.

Also, in another object of the present invention there are provided toner compositions comprised of semicrystalline biodegradable polyesters, especially copolyesters.

Furthermore, in another object of the present invention there are provided positively charged and negatively charged toner compositions useful for the development of images present on positively or negatively charged imaging members.

Additionally, in yet another object of the present invention there are provided toner compositions comprised of biodegradable semicrystalline polyesters and other components including, for example, pigments, dyes, charge additives, surface additives, and the like.

In another object of the present invention there are provided biodegradable toner resin compositions comprised of the semicrystalline polyesters obtained by the synthetic processes illustrated herein.

In yet another object of the present invention there are provided biodegradable single component, and colored toner resin compositions.

Another object of the present invention resides in the provision of a toner wherein low fusing energy is selected.

Additionally, in still another object of the present invention there are provided methods for the development of images, including colored images.

Moreover, in another object of the present invention there are provided processes for the preparation of biodegradale toner resin compositions.

These and other objects of the present invention are accomplished by providing toner and developer compositions. More specifically, the present invention is directed to biodegradable toner resin compositions. In one embodiment, the present invention is directed to toner compositions comprised of biodegradable semicrystalline polyesters. A specific embodiment of the present invention is directed to toners comprised of biodegradable semicrystalline polyesters, including polyhydroxyalkanoates such as polyhydroxybutyrates, polyhydroxyvalerates and copolymers, and blends thereof, preferably with from about 5 mol percent to about 95 mol percent hydroxyvalerate, which polyesters can be prepared by ring opening polymerization of the appropriate lactones, or are available, and containing pigment particles, and optional additives. Blends of the homopolymers contain preferably from about 5 weight percent to about 95 weight percent poly-beta-hydroxyvalerate in poly-beta-hydroxybutyrate. Furthermore, there are provided in accordance with the present invention positively charged toner compositions comprised of biodegradable semicrystalline resin particles, pigment particles, and charge enhancing additives. Another embodiment of the present invention is directed to developer compositions comprised of the aforementioned toners, and carrier particles. Moreover, the present invention is directed to synthetic processes for the preparation of biodegradable semicrystalline polyesters.

In accordance with a preferred embodiment of the present invention, there are provided toner compositions comprised of biodegradable poly-beta-hydroxybutyrate, poly-beta-hydroxyvalerate, copolymers thereof, or blends thereof; pigment particles such as magnetites, carbon blacks or mixtures thereof; and optional charge enhancing additives, particularly, for example, distearyl dimethyl ammonium methyl sulfate, reference U.S. Pat. No. 4,560,635, the disclosure of which is totally incorporated herein by reference, TP-302 available from Nachem Industries or Broton P51. As preferred carrier components for the formation of developers by admixing the aforementioned toners therewith there are selected steel or ferrite materials, particularly with a polymeric coating thereover including the coatings as illustrated in U.S. Ser. No. 751,922, entitled Developer Composition with Specific Carrier Particles, the disclosure of which is totally incorporated herein by reference. One particularly preferred coating illustrated in the aforementioned copending application is comprised of a copolymer of vinyl chloride and trifluorochloroethylene with conductive substances dispersed in the polymeric coating inclusive of, for example, carbon black. One embodiment disclosed in the aforementioned copending application is a developer composition comprised of styrene butadiene copolymer resin particles, pigment particles and charge enhancing additives selected from the group consisting of alkyl pyridinium halides, ammonium sulfates, and organic sulfate or sulfonate compositions; and carrier particles comprised of a core with a coating of vinyl copolymers, or vinyl homopolymers.

Illustrative examples of specific suitable biodegradable polyester toner resins include poly-beta-hydroxyalkanoates, such as poly-beta-hydroxybutyrate, poly-beta-hydroxyvalerate, copolymers thereof such as poly(beta-hydroxybutyrate-co-beta-hydroxyvalerate) containing from, for example, about 5 mol percent to about 95 mol percent hydroxyvalerate, and blends of poly-beta-hydroxybutyrate and poly-beta-hydroxyvalerate with from about 5 weight percent to about 95 weight percent of poly-beta-hydroxyvalerate. The biodegradable resins are present in the toner in various effective amounts such as, for example, from about 70 to about 95 weight percent, and preferably from about 80 to about 90 weight percent. Other amounts outside the ranges indicated can be selected provided the objectives of the present invention are achievable.

Numerous well known suitable pigments can be selected as the colorant for the toner particles including, for example, carbon black, nigrosine dye, aniline blue, phthalocyanine derivatives, magnetites and mixtures thereof. The pigment, which is preferably carbon black, should be present in a sufficient amount to render the toner composition colored thereby permitting the formation of a clearly visible image. Generally, the pigment particles are present in amounts of from about 3 percent by weight to about 20 percent by weight, and preferably from about 8 to about 12 weight percent based on the total weight of the toner composition, however, lesser or greater amounts of pigment particles can be selected providing the objectives of the present invention are achieved.

When the pigment particles are comprised of magnetites, including those commercially available as Mapico Black ®, they are usually present in the toner composition in an amount of from about 10 percent by weight to about 70 percent by weight, and preferably in an amount of from about 10 percent by weight to about 30 percent by weight. Alternatively, there can be selected as pigment particles mixtures of carbon black or equivalent pigments and magnetities, which mixtures, for example, contain from about 6 percent to about 70 percent by weight of magnetite, and from about 2 percent to about 15 percent by weight of carbon black.

Also embraced within the scope of the present invention are colored toner compositions containing as pigments or colorants red, blue, brown, green, magenta, cyan, and/or yellow particles, as well as mixtures thereof. More specifically, with regard to the generation of color images utilizing the toner and developer compositions of the present invention, illustrative examples of magenta materials that may be selected include, for example, 2,9-dimethyl-substituted quinacridone and anthraquinone dye identified in the Color Index as CI 60710, CI Dispersed Red 15, a diazo dye identified in the Color Index as CI 26050, CI Solvent Red 10, Lithol Scarlett, Hostaperm, and the like. Illustrative examples of cyan materials that may be used as pigments include copper tetra-4(octadecyl sulfonamido) phthalocyanine, x-copper phthalocyanine pigment listed in the Color Index as CI 74160, CI Pigment Blue, and Anthrathrene Blue identified in the Color Index as CI 69810, Special Blue X-2137, Sudan Blue, and the like; while illustrative examples of yellow pigments that may be selected include diarylide yellow 3,3-dichlorobenzidene acetoacetanilides, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Permanent Yellow FGL, and the like. These pigments are generally present in the toner composition in an amount of from about 2 weight percent to about 15 weight percent based on the weight of the toner resin particles.

Illustrative examples of optional charge enhancing additives present in various effective amounts such as, for example, from about 0.1 to about 20 percent by weight, and preferably from about 1 to about 5 percent by weight, include alkyl pyridinium halides, such as cetyl pyridinium chlorides, reference U.S. Pat. No. 4,298,672, the disclosure of which is totally incorporated herein by reference, cetyl pyridinium tetrafluoroborates, quaternary ammonium sulfate, and sulfonate charge control agents as illustrated in U.S. Pat. No. 4,338,390, the disclosure of which is totally incorporated herein by reference; stearyl phenethyl dimethyl ammonium tosylates, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; stearyl dimethyl hydrogen ammonium tosylate; and other known similar charge enhancing additives providing the objectives of the present invention are accomplished; and the like. Examples of negative charge additives that may be selected include orthophenylcarboxylic acids, TRH, TP-302 available from Nachem Inc., Broton P51 available from Orient Chemical, and the like. Triboelectric charges of the toner are dependent on a number of factors including the charge additive and carrier selected; generally, however, this charge is from about 10 to about 45, and preferably from about 10 to about 31 microcoulombs per gram.

Illustrative examples of carrier particles that can be selected for mixing with the toner compositions of the present invention include those particles that are capable of triboelectrically obtaining a charge of opposite polarity to that of the toner particles. Accordingly, the carrier particles of the present invention can be selected to be of a negative polarity thereby enabling the toner particles, which are positively charged, to adhere to and surround the carrier particles. Alternatively, there can be selected carrier particles with a positive polarity enabling toner compositions with a negative polarity. Specific illustrative examples of carrier particles that may be selected include granular zircon, granular silicon, glass, steel, nickel, iron, ferrites, reference for example U.S. Pat. Nos. 3,929,657; 4,042,518 and 4,125,667, the disclosures of which are totally incorporated herein by reference, including copper zinc ferrites, and the like. Additionally, there can be selected as carrier particles nickel berry carriers as disclosed in U.S. Pat. No. 3,847,604, which carriers are comprised of nodular carrier beads of nickel characterized by surfaces of reoccurring recesses and protrusions thereby providing particles with a relatively large external area. Preferred carrier particles selected for the present invention are comprised of a magnetic, such as steel, core with a polymeric coating thereover several of which are illustrated, for example, in U.S. Ser. No. 751,922 relating to developer compositions with certain carrier particles, the disclosure of which is totally incorporated herein by reference. More specifically, there are illustrated in the aforementioned copending application carrier particles comprised of a core with a coating thereover of vinyl polymers, or vinyl homopolymers. Examples of specific carriers illustrated in the copending application, and particularly useful for the present invention are those comprised of a steel or ferrite core with a coating thereover of a vinyl chloride/trifluorochloroethylene copolymer, which coating contains therein conductive particles, such as carbon black. Other coatings include fluoropolymers, such as polyvinylidenefluoride resins, poly(chlorotrifluoroethylene), fluorinated ethylene and propylene copolymers, terpolymers of styrene, methylmethacrylate, and a silane, such as triethoxy silane, reference U.S. Pat. Nos. 3,467,634 and 3,526,533, the disclosures of which are totally incorporated herein by reference; polytetrafluoroethylene, fluorine containing polyacrylates, and polymethacrylates; copolymers of vinyl chloride; and trichlorofluoroethylene; and other known coatings. There can also be selected as carriers components comprised of a core with polymer coatings not in close proximity in the triboelectric series, reference U.S. Ser. Nos. 136,791/87, and 136,792/87 the disclosures of which are totally incorporated herein by reference. More specifically, there is detailed in these applications a process for the preparation of carrier particles with substantially stable conductivity parameters which comprises (1) mixing carrier cores with a polymer mixture comprising from about 10 to about 90 percent by weight of a first polymer, and from about 90 to about 10 percent by weight of a second polymer; (2) dry mixing the carrier core particles and the polymer mixture for a sufficient period of time enabling the polymer mixture to adhere to the carrier core particles; (3) heating the mixture of carrier core particles and polymer mixture to a temperature of between about 200° F. and about 550° F. whereby the polymer mixture melts and fuses to the carrier core particles; and (4) thereafter cooling the resulting coated carrier particles, wherein the first and second polymers are not in close proximity in the triboelectric series.

Also, while the diameter of the carrier particles can vary, generally they are of a diameter of from about 50 microns to about 1,000 microns, thus allowing these particles to possess sufficient density and inertia to avoid adherence to the electrostatic images during the development process. The carrier particles can be mixed with the toner particles in various suitable combinations, however, best results are obtained when about 1 to about 5 parts of toner to about 10 parts to about 200 parts by weight of carrier are mixed. Carrier coating weights depend on a number of factors, including the core selected; generally, however, a coating weight of from about 0.1 to about 5 and preferably from about 1 to about 3 weight percent can be selected.

The toner compositions of the present invention can be prepared by a number of known methods, including mechanical blending and melt blending the biodegradable polyester toner resin particles, pigment particles or colorants, and other components followed by mechanical attrition. Other methods include those well known in the art such as spray drying, mechanical dispersion, melt dispersion, melt extrusion/melt dispersion in which from about 10 to 50 percent by weight of the resin is dispersed in a second polymer by melt extrusion, dispersion polymerization, and suspension polymerization. In one dispersion polymerization method, a solvent dispersion of the biodegradable semicrystalline polyester resin particles, the pigment particles, and charge enhancing additive are spray dried under controlled conditions to result in the desired product. Thereafter, the toner is classified to enable toners with an average particle diameter of from about 5 to about 25 microns, and preferably from about 10 to about 20 microns, having a minimum fix temperature of about 300° to about 400° F., which temperature can be altered by, for example, varying the composition of polymer by blending two polyesters, and/or by changing the molecular weight of the polyesters. A low minimum fix temperature of from about 300° to about 340° F. are obtained with copolymers containing from about 30 to 40 mol percent of beta-hydroxyvalerate or with blends of poly-beta-hydroxybutyrate and poly-beta-hydroxyvalerate containing from about 30 to 40 weight percent of poly-beta-hydroxyvalerate.

In one specific process, the preparation of toner compositions comprises the extrusion of a semicrystalline biodegradable polyester blended with polyethyloxazoline, polyvinylpyrrolidone, polyvinylalcohol or other water soluble polymer; grinding the extrudate, treating with water to dissolve the polyethyloxazoline, polyvinylpyrrolidone, polyvinylalcohol, or other water soluble polymer, and thereafter filtering.

The toner and developer compositions of the present invention may be selected for use in developing images in electrostatographic imaging systems containing therein, for example, conventional photoreceptors, such as selenium and selenium alloys, such as selenium arsenic, selenium tellurium, and the like. Also useful, especially wherein there is selected positively charged toner compositions, are layered photoresponsive devices comprised of transport layers and photogenerating layers, reference U.S. Pat. Nos. 4,265,990; 4,585,884; 4,584,253 and 4,563,408, the disclosures of which are totally incorporated herein by reference, and other similar layered photoresponsive devices. Examples of photogenerating layers include selenium, selenium alloys, trigonal selenium, metal phthalocyanines, metal free phthalocyanines and vanadyl phthalocyanines, while examples of charge transport layers include the aryl amines as disclosed in U.S. Pat. No. 4,265,990. Other photoresponsive members that may be useful in the present invention include layered members as illustrated in the '990 patent with 4-dimethylaminobenzylidene, 2-benzylidene-amino-carbazole; (2-nitrobenzylidene)-p-bromoaniline; 1,5-diphenyl-3-methyl pyrazoline; 2-(4'-dimethyl-amino phenyl)-benzoaxzole; 3-aminocarbazole; hydrazone derivatives; polyvinyl carbazole-trinitrofluorenone charge transfer complex; and mixtures thereof. Moreover, there can be selected as photoconductors hydrogenated amorphous silicon; and as photogenerating pigments squaraines, perylenes, and the like.

Moreover, the toner and developer compositions of the present invention are particularly useful with electrostatographic imaging apparatuses containing a development zone situated between a charge transporting means and a metering charging means, which apparatus is illustrated in U.S. Pat. Nos. 4,394,429 and 4,368,970, the disclosures of which are totally incorporated herein by reference. More specifically, there is illustrated in the aforementioned '429 patent a self-agitated, two-component, insulative development process and apparatus wherein toner is made continuously available immediately adjacent to a flexible deflected imaging surface, and toner particles transfer from one layer of carrier particles to another layer of carrier particles in a development zone. In one embodiment, this is accomplished by bringing a transporting member, such as a development roller, and a tensioned deflected flexible imaging member into close proximity, that is a distance of from about 0.05 millimeter to about 1.5 millimeters, and preferably from about 0.4 millimeter to about 1.0 millimeter in the presence of a high electric field, and causing such members to move at relative speeds. There is illustrated in the aforementioned '970 patent an electrostatographic imaging apparatus comprised of an imaging means, a charging means, an exposure means, a development means, and a fixing means, the improvement residing in the development means comprising in operative relationship a tensioned deflected flexible imaging means; a transporting means; a development zone situated between the imaging means and the transporting means, the development zone containing therein electrically insulating magnetic carrier particles; means for causing the flexible imaging means to move at a speed of from about 5 cm/sec (centimeters/second) to about 50 cm/sec; means for causing the transporting means to move at a speed of from about 6 cm/sec to about 100 cm/sec, the means for imaging and the means for transporting moving at different speeds; and the means for imaging and the means for transporting having a distance therebetween of from about 0.05 millimeter to about 1.5 millimeters.

Moreover, as indicated herein surface additives such as metal salts, colloidal silicas, reference for example U.S. Pat. Nos. 3,590,000; 3,655,374; 3,720,617 and 3,900,503, the disclosures of which are totally incorporated herein by reference, metal oxides and the like may be added to the toners of the present invention in various effective amounts such as, for example, from about 0.1 to about 1 weight percent.

An especially preferred developer composition of the present invention is comprised of a toner composition with 74 weight percent of a biodegradable poly-beta-hydroxybutyrate-co-beta-hydroxy valerate copolymer, about 16 percent by weight of magnetite, and about 10 percent by weight of carbon black, and carrier particles.

One preferred carrier is comprised of a steel core with a coating thereover of a polymer of, for example, a vinyl chloride/trichlorofluorethylene copolymer available as FPC 461, which coating has dispersed therein carbon black particles of about 10 to about 25 weight percent.

The synthetic process of the present invention for the preparation of the biodegradable polyesters comprises the ring opening polymerization of a racemic monomer such as a lactone, including beta-lactones such as beta-butyrolactone (also available from Aldrich Chemical) in the presence of a catalyst such as a trialkylmetal, optionally with water as a cocatalyst (a complex of the trialkylmetal and water), thereby causing reaction of the monomer with itself. Usually, the polymerization reaction is accomplished in the presence of heat, followed by cooling, preferably to room temperature, 20° C., thereafter dissolving the formed polymer in a solvent, precipitating the polymer with a nonsolvent, and optional further purification by, for example, extraction processes, if desired. The product, which is of a number of a average molecular weight of from about 5,000 to 500,000, as determined by GPC and intrinsic viscosity measurement, can be identified by, for example, NMR, analytical data, and the like.

Specifically, while not desired to be limited to the reactions parameters that follow a dry monomer such as beta-butyrolactone or beta-valerolactone, about 5.0 milliliters is added to a high vacuum ampoule capable of retaining a vacuum of $10^{-6}$ mbar and a dry nitrogen feed line is inserted into the ampoule to allow a steady gas flow. Two milliliters of a 1.9M (Molar) triethyl aluminum catalyst ($AlEt_3$) solution in toluene is added to the ampoule at −78° C., followed by the optional addition of dry chloroform ($CHCl_3$). The nitrogen purge is then removed and an accurately measured amount of water (preferably from about 10 to about 130 μL) is added by microsyringe to form a catalyst complex before the ampoule is mounted on the vacuum line. The reaction mixture is then degassed by 3 freeze/-pump/thaw cycles to a residual pressure of $5\times10^{-5}$ mbar. Subsequently, polymerization can be accomplished at a temperature of from about 30 to about 70° C. for periods of 7 to 14 days and preferably for a period sufficient to produce the desired semicrystalline polyester polymer in 90 percent yield. Depending on the amount of solvent, such as $CHCl_3$, the molecular weight generally increases significantly with time. For purification, the polymerization product is worked up by dissolving the product in a halogenated solvent, such as $CHCl_3$, at about 60° C. The formed solutions are then added dropwise to 500 milliliters of diethyl ether/petroleum ether (75/25 for poly-beta-hydroxybutyrate and 25/75 for poly-beta-hydroxyvalerate) containing a few volume percent of water yielding a flocculant precipitate.

To provide a stereoregular polymer, the aforesaid precipitated polymer is extracted with, for example, acetone (for poly-beta-hydroxybutyrate) or ethanol (for poly-beta-hydroxyvalerate) for 5 to 10 hours in a Soxhlet apparatus, and subsequently stirred in acetylacetone (10 milliliters per gram of polymer) for 2 days in order to remove the catalyst. The polymer is then precipitated in ethanol (5 milliliters/milliliter of acetylacetone), centrifuged, reimmersed twice in diethyl ether and dried.

Effective amounts of the racemic monomer are selected, which amounts depend on a number of factors including the monomer utilized, the catalyst employed, reaction conditions, whether laboratory or commercial quantities are desired, and the like. Generally, for example, from about 5 milliliters to about 1,000 milliliters of monomer are selected.

Examples of catalysts include triethyl aluminum, trimethyl aluminum, dimethyl zinc, diethyl zinc, other alkyl metals wherein alkyl is from 1 to about 6 carbon atoms, and the like. In one embodiment, the catalyst amount is from about 2 to about 10 mole percent based on the weight of monomer. Also, catalyst complexes in similar amounts can be selected, which complexes can be formed, for example, by admixing the alkyl metal catalyst with water as indicated herein, ratio of catalyst to water being from about 0.5 to about 2.0.

Specific examples of solvents, preferably in an amount of from about 10 to about 70 weight percent, based on the monomer weight, selected for the process of the present invention include aliphatic halogenated solvents such as methylene chloride, trichloroethane, and the like; acetates such as ethyl acetate; alcohols such as ethanol; and the like providing the objectives of the present invention are achieved. Nonsolvent examples, preferably present in an amount that exceeds the amount of solvent present, include acetone, alkyl ethers, methanol, and the like providing the objectives of the present invention are achieved, that is for example the nonsolvent precipitates the polymer product.

Also, for the process of the present invention the polymerization is accomplished at from about 30° to 70° C., and preferably 50° to 60° C., The process of the present invention is directed to, in one embodiment, the preparation of poly-beta-hydroxyalkoates, which comprises the ring opening polymerization of a monomer selected from lactones in the presence of an alkyl metal catalyst with heating, or a process for the chemical synthesis of beta-hydroxyalkanoates in the absence of enzymes, which comprises the ring opening polymerization of beta-butyrolactone and/or beta-valerolactone in the presence of an alkyl metal catalyst or an alkyl metal catalyst in a solvent with heating at a temperature of from about 30° to about 70° C., thereafter cooling, dissolving the polymer formed in a suitable solvent, and precipitating the polymer product with a suitable nonsolvent.

The following examples are being submitted to further define various species of the present invention. These examples are intended to illustrate and not limit the scope of the present invention. Also, parts and percentages are by weight unless otherwise indicated.

EXAMPLE I

A polymer of beta-hydroxyvalerate was synthesized by the ring opening polymerization of racemic beta-valerolactone, which was prepared by reacting propionaldehyde with malonic acid to form beta-pentenoic acid via the Knoevenagel reaction, followed by beta-bromination and lactonization. More specifically, beta-pentenoic acid, racemic beta-bromopentenoic acid and racemic beta-valerolactone were synthesized as follows.

Beta-Pentenoic Acid: A flask was equipped with a mechanical stirrer and a dry ice condenser fitted with a $CaCl_2$ drying tube. To 206 grams (2.6 mole) dry pyridine, cooled to 0° C., 204 grams (2 mole) of dry malonic acid and then 146 grams (2.5 mole) dry propionaldehyde were added with constant stirring. The ice-water bath was removed and the mixture was left stirring at room temperature. Additional 0.5 mole portions of malonic acid were added on the second and third days of the reaction. After 6 days, 400 milliliters of 50 percent sulfuric acid was added with stirring to the ice-cooled mixture. Cooling of the resulting mixture caused most of the beta-pentenoic acid to separate as a clear oil. The remaining aqueous layer was extracted 6 times with 75 to 100 milliliters portions of diethyl ether, and the combined organic fractions were dried over anhydrous MgSO4. After filtration, the solvent was removed by evaporation. The crude product was fractionally distilled through a Vigreux column at reduced pressure to provide beta-pentenoic acid (82 percent yield with a purity of about 99.99 percent as determined by $^1H$ NMR). $^1H$ NMR ($CDCl_3$, 80 MHz) δ 12.19 (s, 1H), 7.18 (m, 1H), 5.82 (d, 1H), 2.27 (m, 2H), 1.08 (t, 3H).

(±)Beta-Bromopentanoic Acid: beta-Pentenoic acid (30 grams) was saturated with dry HBr gas at room temperature and the gas was bubbled periodically through the stirred solution. The conversion to beta-bromopentanoic acid was followed by 1H NMR, and exceeded 99 percent after 7 days. The crude product was fractionally distilled twice under high vacuum to provide pure beta-bromopentanoic acid (97 percent yield; mp 59° C., lit. 58.5 to 59° C.); 1H NMR (CDCl3, 250 MHz) δ 11.39 (s, 1H), 4.29 (m, 1H), 2.97 (d, 2H), 1.88 (m, 2H), 1.07 (t, 3H). When the reaction was repeated with 280 grams of beta-pentenoic acid, the conversion was only 80 percent after 17 days. Removal of beta-pentenoic acid was achieved by recrystallization of the product from the minimum amount of hexane/-chloroform, rather than by distillation.

(±)Beta-Valerolactone: To a stirred solution of 70 grams (0.39 mole) of beta-bromopentanoic acid in 600 milliliters $CHCl_3$, a solution of 32 grams (0.30 mole) of $Na_2CO_3$ in 200 milliliters of water was added slowly. The mixture was stirred vigorously for 6 hours at 40° C. The water phase was extracted with $CHCl_3$, the combined $CHCl_3$ fractions were dried over $MgSO_4$, and the $CHCl_3$ was removed under vacuum. The crude beta-valerolactone was dried by stirring overnight over $CaH_2$ at room temperature, and was purified by fractional distillation twice under high vacuum and stored under $N_2$ over 4 Å molecular sieves (70 percent yield; about 99 to 99.999 percent purity as determined by $^1H$ NMR; $n^{20}_D = 1.4191$, lit. $= 1.4190^{21}$). IR(neat) 1,822 $cm^{-1}$; $^1H$ NMR ($CDCl_3$, 250 MHz) δ 4.48 (m, 1H), 3.29 (quartet of d, 2H), 1.86 (m, 2H), 1.02 (t, 3H).

Polymerization of racemic valerolactone to form poly-beta-hydroxyvalerate was performed as follows. Dry beta-valerolactone (5.00 milliliters) was added to a high vacuum ampoule, and a dry $N_2$ feed line was inserted into the ampoule allowing a steady gas flow. Two milliliters of a 1.9M $AlEt_3$ solution in toluene (available from Aldrich) was added to the ampoule at −78° C., followed by the addition of dry $CHCl_3$, 3 milliliters, 60 percent. The $N_2$ purge was then removed and 130.0 μL (microliters) of water was added by microsyringe before the ampoule was mounted on the vacuum line. The above mixture was then degassed by 3 freeze/pump/thaw cycles to a residual pressure of $5 \times 10^{-5}$ mbar. Polymerization was accomplished at 60° C. for 7 days. The polymer product was diluted to a final polymer concentration of 1 to 2 weight percent in $CHCl_3$ at 60° C., and worked up by adding acetylacetone (10 milliliters per gram of polymer) and stirring for 2 days to remove the triethyl aluminum water complex catalyst. The aforementioned solution formed was then added dropwise to 500 milliliters of diethyl ether/petroleum ether (25/75 by volume) containing a few volume percent of water, yielding a flocculant precipitate of poly-beta-hydroxyvalerate, which was a mixture of both stereoregular and stereoirregular polymer as shown by NMR. The number average molecular weight of the poly-beta-hydroxyvalerate was 35,000 as determined by GPC, and the melting point was 120° C.

EXAMPLE II

A polymer of beta-hydroxybutyrate was prepared from racemic beta-butyrolactone (Aldrich) by repeating the polymerization and other appropriate steps of Example I with the exception that the polymer mixture was isolated from the reaction mixture by precipitation with the dropwise addition of diethyl ether/petroleum ether (75/25 by volume) containing two volume percent of water. The resulting polymer was a mixture of both stereoregular and stereoirregular poly-beta-hydroxybutyrate as evidenced by NMR. The number average molecular weight of the polymer was 14,000 as determined by GPC and the melting point was 170° C.

EXAMPLE III

A polymer of beta-hydroxybutyrate was prepared by repeating the process of Examples II with the exception that the trialkyl metal $AlMe_3$ was selected in place of $AlEt_3$.

EXAMPLE IV

Copolymers of beta-hydroxybutyrate and beta-hydroxyvalerate containing 30 mole percent beta-hydroxyvalerate were prepared by repeating the process of Example II with the exception that the dry racemic beta-butyrolactone employed was replaced by a mixture containing 30 mole percent of dry racemic beta-valerolactone with 70 mole percent racemic beta-butyrolactone. The resulting copolymer was a mixture of stereoregular and stereoirregular copolymers containing 30 mole percent beta-hydroxyvalerate as shown by NMR. The number average molecular weight of this copolymer was 20,000 as determined by GPC and the melting point was 120° C.

The polymers of Examples I to IV were retained at room temperature, 20° C., until semicrystalline polymers formed.

EXAMPLE V

Stereoregular poly-beta-hydroxyvalerate was isolated from the mixture of stereoregular and stereoirregular poly-beta-hydroxyvalerate prepared in Example I by extraction with ethanol for 5 to 10 hours in a Soxhlet apparatus. The polymer was then precipitated with the dropwise addition of diethyl ether/petroleum ether (75/25 by volume) containing a few volume percent of water, centrifuged, reimmersed twice in diethyl ether and dried. The resulting semicrystalline poly-beta-hydroxyvalerate was greater than 90 percent stereoregular as shown by NMR, the melting point was 120° C., and the number average molecular weight was 52,000 as determined by GPC.

EXAMPLE VI

Stereoregular poly-beta-hydroxybutyrate was isolated from the mixture of stereoregular and stereoirregular poly-beta-hydroxybutyrate prepared in Example II by extraction with acetone for 5 to 10 hours in a Soxhlet apparatus. The polymer was then precipitated with dropwise addition of diethyl ether/petroleum ether (25/75 by volume) containing a few volume percent of water, centrifuged, reimmersed twice in diethyl ether and dried. The resulting semicrystalline poly-beta-hydroxybutyrate was greater than 90 percent stereoregular as shown by NMR, the melting point was 170° C., and the number average molecular weight was 21,000 as determined by GPC.

EXAMPLE VII

Stereoregular poly(beta-hydroxybutyrate-co-beta-hydroxyvalerate) was isolated from the mixture of stereoregular and stereoirregular poly(beta-hydroxybutyrate-co-beta-hydroxyvalerate) prepared in Example IV by extraction with ethanol for 5 to 10 hours in a Soxhlet apparatus. The copolymer was then precipitated with dropwise addition of diethyl ether/petroleum ether (75/25 by volume) containing a few volume percent of water, centrifuged, reimmersed twice in diethyl ether and dried. The resulting semicrystalline poly(beta-hydroxybutyrate-co-beta-hydroxyvalerate) was greater than 90 percent stereoregular as shown by NMR, the melting point was 120° C., and the number average molecular weight was 35,000 as determined by GPC.

The above semicrystalline polymers obtained an equilibrium degree of crystallinity of about 60 percent after remaining at room temperature, 20° C., for about three weeks.

EXAMPLE VIII

There was prepared by melt extrusion at 120° C. a toner containing 74 weight percent of a bacteria origin poly(beta-hydroxybutyrate-co-27 percent-beta-hydroxyvalerate) copolymer obtained from ICI, believed to be prepared by the fermentation of bacteria, reference, for example, European Patent Publication Nos. 0,052,459 and 0,069,497, the disclosures of which are totally incorporated herein by reference, 10 percent Regal 330® carbon black and 16 percent Mapico magnetite. The extrudate was pulverized in a Waring blender using dry ice. The particles were then mixed at 25 percent with polyethyloxazoline (PEOX-50, Dow) and extruded at 120° C. The extrudate was again ground using a Waring blender and treated with water (500 milliliters per 20 grams) to dissolve the polyethyloxazoline. Methanol (5 milliliters) was added to control foaming. After 2 hours stirring at 25° C., the aqueous mixture was filtered using 30 micron Nylon filter cloth (Tetko) and the solids collected were washed with water and then methanol to facilitate drying and to remove any lipid material which was present. After drying in vacuo, the solids were collected and ground in a coffee grinder to yield 3 to 10 micron particles (average diameter) of poly(beta-hydroxybutyrate-co-27 percent-beta-hydroxyvalerate) containing 10 percent Regal 330® carbon black and 16 percent magnetite in 90 percent yield. The particles did not need to be classified for use as a xerographic toner.

Thereafter, a positive toner with a tribo charge of from +5 to +15 μC/g, and more preferably for the above toner +10 μC/g at a toner concentration of 2 percent against carrier particles comprised of a steel core, 60 grams, with two polymers not in close proximity in the triboelectric series thereover, 1.25 weight percent coating weight, which polymers were comprised of 70 percent of Kynar and 30 percent of polymethylmethacylate, was prepared by surface treating the above prepared toner particles (2 grams) with 0.12 gram of a 1:1 weight ratio of Aerosil and TP-302, available from Nachem Industries, using a coffee grinder. The carrier particles as indicated were comprised of a core of steel with a coating thereover, 1.25 weight percent of Kynar/PMMA-polymethylmethacrylate (70/30) carrier (60 grams per 2 grams of toner). The resultant developer was then selected for the development of images by cascade development in a Model D imaging test fixture with a positively charged selenium photoreceptor under standard development conditions using a "negative" target. The light exposure was between 5 and 10 seconds and a negative bias was used to dark transfer the positive toner images from the photoreceptor to paper. Fusing evaluations were carried out with a silicon hard roll fuser set at various temperatures to determine hot offset temperature and minimum fix temperature. Fuser speed was about 3 inches per second using standard nip pressure. Silicone oil was applied sparingly to the fuser with a paper towel. The fuser set temperature was determined with an Omege pyrometer. Best fix, as judged by crease and Tabor abrasion tests, took place at 380° F. (fuser set temperature). Image quality, fix and permanence were excellent and the toners did not block in an oven set at 80° C.

It is believed that similar toners and developers as prepared above can be formulated with the semicrystalline polyesters of Examples V, VI and VII. Also, it is believed that imaging characteristics for such toners will be substantially equivalent to the above in the Model D test fixture.

Other modifications of the present invention may occur to those skilled in the art subsequent to a review of the present application. The aforementioned modifications, including equivalents thereof, are intended to be included within the scope of the present invention.

What is claimed is:

1. A toner composition comprised of biodegradable semicrystalline polyester resin particles and pigment particles.

2. A toner composition in accordance with claim 1 wherein the semicrystalline polyester is comprised of a polyhydroxyalkanoate, copolymers thereof, or blends of polyhydroxyalkanoates and pigment particles.

3. A toner composition in accordance with claim 1 wherein the polyhydroxyalkanoates are selected from the group consisting of poly-beta-hydroxybutyrate, poly-beta-hydroxyvalerate, poly-beta-hydroxybutyrate-co-beta-hydroxyvalerate, and blends thereof.

4. A toner composition in accordance with claim 1 wherein the copolymer contains from about 5 mol percent to about 95 mol percent hydroxyvalerate, and the blends are comprised of poly-beta-hydroxybutyrate and poly-beta-hydroxyvalerate containing from about 5 weight percent to about 95 weight percent of poly-beta-hydroxyvalerate.

5. A toner composition in accordance with claim 1 wherein the number average molecular weight of the polyester is from about 5,000 to about 500,000.

6. A toner composition in accordance with claim 2 wherein the pigment particles are carbon black, magnetite, mixtures thereof, magenta, cyan, yellow, or mixtures thereof.

7. A toner composition in accordance with claim 6 wherein the mixture contains from about 6 percent by weight to about 70 percent by weight of magnetite, and from about 2 percent by weight to about 15 percent by weight of carbon black.

8. A toner composition in accordance with claim 2 containing a charge enhancing additive.

9. A toner composition in accordance with claim 7 wherein the charge enhancing additive is selected from the group consisting of distearyl dimethyl ammonium methyl sulfate, cetyl pyridinium halides, and stearyl phenethyl dimethyl ammonium tosylate.

10. A developer composition comprised of the toner composition of claim 1, and carrier particles.

11. A developer composition comprised of the toner composition of claim 2, and carrier particles.

12. A developer composition comprised of the toner composition of claim 3, and carrier particles.

13. A developer composition in accordance with claim 11 wherein the carrier particles are comprised of a core with a polymeric coating thereover.

14. A developer composition in accordance with claim 12 wherein the carrier particles are comprised of a core with a polymeric coating thereover.

15. A developer composition in accordance with claim 14 wherein the carrier particles are comprised of a steel or a ferrite core with a coating thereover selected from the group consisting of polychlorotrifluoroethylene-co-vinylchloride copolymer, a polyvinlidene fluoropolymer, or a terpolymer of styrene, methacrylate, and an organo silane, fluorinated ethylene-propylene copolymers, and polytetrafluoroethylene.

16. A developer composition in accordance with claim 14 wherein the pigment particles for the toner are comprised of a mixture of carbon black and magnetites, carbon black, or magnetite, red, blue, green, brown, magenta, cyan, yellow, and mixtures thereof.

17. A developer composition in accordance with claim 14 wherein the toner contains a charge enhancing additive selected from the group consisting of distearyl dimethyl ammonium methyl sulfate, cetyl pyridinium halides, and stearyl phenethyl dimethyl ammonium tosylate.

18. A toner composition comprised of the polymer made by the process of chemically synthesizing a biodegradable semicrystalline polyester in the absence of enzymes, and which comprises the ring opening polymerization of a suitable monomer in the presence of a catalyst and pigment particles.

19. A toner composition comprised of the polymer made by the process of preparing a poly-beta-hydroxyalkanoate by ring opening polymerization of a monomer selected from lactones in the presence of an alkyl metal catalyst with heating and pigment particles.

20. A developer composition comprised of the toner composition of claim 18 and carrier particles.

21. A developer composition comprised of the toner composition of claim 19 and carrier particles.

22. A method for obtaining images which comprises generating an electrostatic latent image on a photoconductive imaging member, subsequently affecting development of this image with the toner composition of claim 1, thereafter transferring the image to a permanent substrate, and optionally permanently affixing the image thereto.

23. A method for obtaining images which comprises generating an electrostatic latent image on a photoconductive imaging member, subsequently affecting development of this image with the toner composition of claim 3, thereafter transferring the image to a permanent substrate, and optionally permanently affixing the image thereto.

* * * * *